US006351517B1

(12) United States Patent
Guru et al.

(10) Patent No.: US 6,351,517 B1
(45) Date of Patent: Feb. 26, 2002

(54) METHOD AND APPARATUS FOR PREDICTING X-RAY TUBE FAILURES IN COMPUTED TOMOGRAPHY SYSTEMS

(75) Inventors: Shankar Visvanathan Guru; Peter Michael Edic, both of Schenectady; Allan John Connolly, Albany; Harry Kirk Mathews, Jr., Clifton Park, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/575,699

(22) Filed: Jul. 7, 2000

(51) Int. Cl.[7] ..... H05G 1/08
(52) U.S. Cl. ..... 378/91; 378/4
(58) Field of Search ..... 378/4, 91, 210

(56) References Cited

U.S. PATENT DOCUMENTS 4,991,189 A * 2/1991 Boomgaarden et al. ..... 378/4

5,400,378 A * 3/1995 Toth ..... 378/16

* cited by examiner

*Primary Examiner*—David V. Bruce
(74) *Attorney, Agent, or Firm*—Donald S. Ingram; Christian G. Cabou

(57) ABSTRACT

In predicting failure of an x-ray tube in a computed tomography (CT) system, reference detector elements normally disposed on each end of the detector, receive x-rays directly from the x-ray tube. In accordance with the invention, the output values of the reference detector elements are utilized by a tube condition prediction algorithm to predict a failure in the x-ray tube of the CT system. The tube condition prediction algorithm utilizes at least one model of the CT system and at least one prediction routine, which typically is a Kalman filter, to generate the prediction. The prediction routine uses the model to analyze the output values of the reference detector elements in order to determine the condition of the x-ray tube and predict future performance of the x-ray tube.

30 Claims, 4 Drawing Sheets

METHOD AND APPARATUS FOR PREDICTING X-RAY TUBE FAILURES IN COMPUTED TOMOGRAPHY SYSTEMS

BACKGROUND OF THE INVENTION

The invention generally relates to computed tomography (CT) systems and, more particularly, to a method and apparatus for predicting failures in x-ray tubes utilized in CT systems.

The sub-systems of a CT system include the x-ray tube, the detector elements and the read-out electronics associated with the detector elements. When any of these sub-systems fail, the CT system formally is taken off-line until the sub-system that has failed has been repaired.

Currently, no suitable techniques have been implemented for predicting when one of these CT sub-systems is going to fail. The x-ray tube is the most often serviced and replaced sub-system of any CT system. Due to the frequency with which replacements must be made, x-ray tubes typically are not covered by the CT systems warranty. Therefore, a separate warranty normally must be purchased for the x-ray tube.

An early prediction of an imminent failure of the x-ray tube could reduce the amount of time the CT system will be down, or inoperable, which would greatly increase customer satisfaction. Also, accurate advance warnings of imminent failures of the x-ray tube could enable hospitals to schedule their down times, thus minimizing the adverse impacts on patient scheduling of replacing the x-ray tube. An early warning of imminent failure of the x-ray tube could also provide servicing personnel with lead-time to order and replace the x-ray tube, which could reduce the costs involved in servicing CT systems.

One approach is to estimate the life span of a CT system x-ray tube based on historical data gathered from other CT system x-ray tubes. For example, the average life span of CT system x-ray tubes has been determined by utilizing historical data relating to when certain x-ray tubes were put into use and when they failed. Since x-ray tubes do not all operate under identical conditions, the average life span is not necessarily a good indicator of when a particular x-ray tube will fail.

Other attempts have been made to predict the life of a CT system x-ray tube, taking into account external operational conditions of the x-ray tube, such as x-ray tube pressure and temperature, to make a prediction. However, this prediction technique has mixed results for predicting the performance of a given x-ray tube.

Accordingly, a need exists for a method and apparatus that enable failures of x-ray tubes of CT systems to be accurately predicted.

SUMMARY OF THE INVENTION

The invention provides a method and apparatus for predicting the condition of an x-ray tube of a computed tomography (CT) system. Output values of at least one reference detector element in the CT system are utilized by the apparatus of the present invention in conjunction with a tube condition prediction algorithm to predict the condition of the x-ray tube in the CT system.

DETAILED DESCRIPTION OF THE INVENTION

The present invention provides means for assessing the predicting failure of an x-ray tube in an imaging system 2. By way of example, and not limitation, the apparatus and method of the present invention is described with respect to one embodiment in which it is used, that of a computed tomography ("CT") systems. The systems of the present invention can be used with x-ray imaging systems, which refer to a system for imaging objects with x-rays that employs radiation detectors as described herein. The solid state radiation detector comprises a plurality of detector elements, as described more fully below for certain embodiments, that provide electrical signals representative of the detected incident x-ray radiation. These electrical signals from the respective detector elements are then processed to provide a representation of the image of the object being irradiated. Commonly, the solid state radiation detector comprises a scintillator coupled to a photosensor array, although alternative embodiments can employ semiconductor devices for direct detection of incident radiation.

Figure 1:
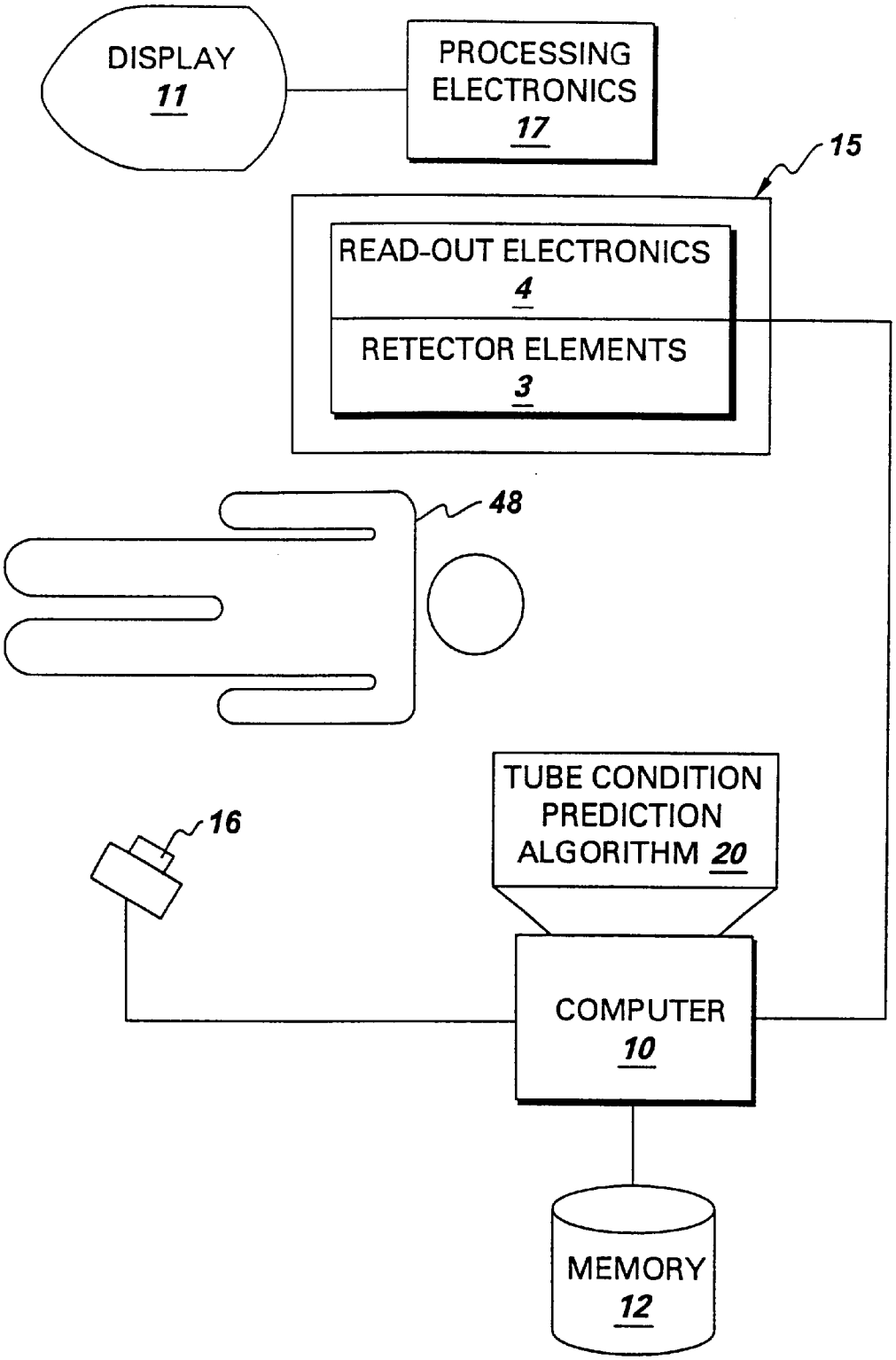
FIG. 1 is a block diagram of a CT system comprising various sub-systems.

FIG. 1 is a block diagram of a typical CT system 2 being used to image a patient 18. The CT system comprises various sub-systems for acquiring a CT image of the patient 18, for processing electrical signals associated with the image, and for displaying the CT image. The CT system comprises an x-ray source 16, which comprises an x-ray tube (not separately shown), a detector assembly 15 which comprises a plurality of detector elements (not separately shown in FIG. 1) that receives the x-rays that pass from x-ray source 16 and generate corresponding electrical signals. Read-out electronics 17 are coupled to detector assembly 15 to read the electrical signals, amplify the signals as necessary, and provide the electrical signals representative of the detected incident radiation to a system controller and processor 5 for processing of the signals.

Processor 5 comprises, e.g., an image reconstruction computer 7 configured to process the acquired image data signals to reconstruct a CT image and provide the reconstructed CT image to be displayed on the display monitor 11. Processor 5 further comprises a system performance computer 10 configured to execute a failure prediction algorithm as described below. As used herein, "configured to," "adapted to," and the like refer to processing devices such as programmable digital computers, application specific integrated circuits (ASICs), that manipulate input data signals in a manner to provide a desired output signal. The term "computer", as that term is used herein, is intended to denote any machine capable of performing the calculations, or computations, necessary to perform the manipulations of signals for generation of, e.g., outputs in steps of the failure prediction process of the invention. In essence, this includes any machines that is capable of accepting a structured input and of processing the input in accordance with prescribed rules to produce an output. Thus computer 10 is not limited to any particular physical, structural, or electrical configuration.

Processor 5 typically further comprises a memory device 12 that stores various programs and/or data utilized by the performance computer 10 and image reconstruction computer 7. Reference to image reconstruction computer 7 and system performance computer 10 is made for convenience in describing the apparatus of the present invention and does not necessarily imply that separate and distinct digital computing devices need to be used, but rather indicates that there is a digital computing device configured to execute the particular algorithms described herein.

Performance assessment computer 10 executes a tube condition prediction algorithm 20 to provide a signal as described herein. By way of examples and not limitation, the device of the present invention is readily implemented as a part of an overall system performance algorithm, as described in copending application Ser. No. 09/575,698 (RD 26209), entitled, "A Method and Apparatus for Assessing the Performance of an X-ray Imaging System," filed contemporaneously herewith. Typically the algorithm of the present invention is implemented in software, which is executed by the computer 10; in alternative embodiments, however, the performance assessment algorithm may be implemented solely in hardware or in a combination of hardware and software.

Memory device 12 typically is utilized for storing the software that performs the performance assessment algorithm, for storing data utilized by and generated by the performance assessment algorithm. For example, historical performance data of the particular imager (or alternatively, a plurality of imagers appropriate for comparison) may be used in generation of performance profiles and expected future performance.

Figure 2:
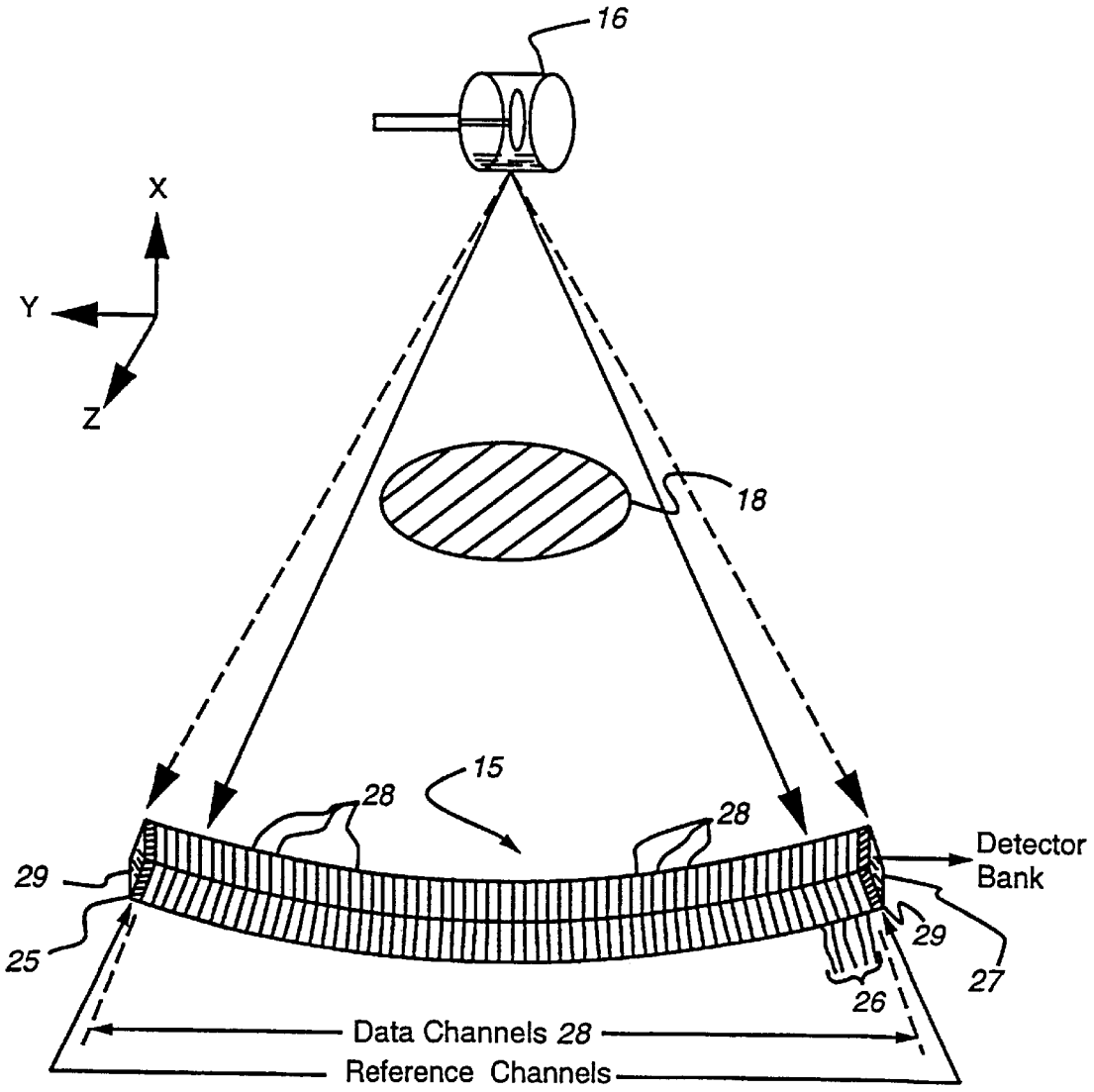
FIG. 2 is a drawing depicting the detector shown in FIG. 1 and the reference detectors located near the ends of the detector.

Detector assembly 15 comprises a plurality of detector channels 26 (a representative number of which are indicated in FIG. 2). Each detector channel 26 corresponds to at least one (and, alternatively, multiple) detector element 28, e.g., a photodiode or the like that is used to generate the electrical signals representative of radiation incident on a given portion (typically referred to as a pixel) of the detector assembly. In CT applications, it is common that multiple channels are bundled together in modules for ease of packaging (e.g., currently a typical CT detector assembly comprises 57 modules, each of which comprises 16 detector elements).

Detector channels 26 further comprise data channels 28 and at last one reference channel 25. The reference channel provides a signal indicative of detected x-rays that have not interacted with (e.g., have not been attenuated by passing through object 18 that is being imaged. Thus, the reference channel provides a signal representative of x-ray flux generated by x-ray source 16. The data channels are disposed to receive radiation emanating from source 15 that passes through object 18 that is due to be imaged. The data channels thus provide respective signals representative of the attenuation of the x-ray signal resulting from passage through object 18 to be imaged, which signals are processed for display of the image.

Detector assembly 15 in a CT system commonly comprises two reference detector elements 25 and 27, with associated respective reference channels 29 that provide the reference channel output signal. The reference detectors are typically disposed adjacent to the ends of the detector assembly 15, as shown in FIG. 2. The reference detectors are disposed so as to receive x-rays directly from source 16 without the x-rays interacting with an object 18 that is imaged by the imager. Alternative locations for reference detectors are possible, given particular array designs and uses, so long as there is an uninterrupted path for x-rays to the reference detector for times when the reference detector is providing signals for a reference channel.

As noted above and illustrated in FIG. 2, the detector elements disposed between the reference detector elements comprise the data detector elements, which capture x-rays that pass through an object being imaged by the CT system.

In the system of the present invention, computer 10 comprises a tube condition prediction device 20 to predict the condition of an x-ray tube in the CT system, and in particular provides an indication when a failure in the x-ray tube is likely to occur. As used herein, "tube condition prediction device" is used broadly to include all algorithm modalities for prediction of the condition of the x-ray tube (e.g., including algorithm modalities that would indicate the x-ray tube is in satisfactory condition or nearing a failure mode). In accordance with one embodiment of the invention, the tube condition prediction device 20 is implemented in software, which is executed by the computer 10. However, those skilled in the art will understand that the tube condition prediction device 20 may alternatively be implemented solely in hardware of in a combination of hardware and software.

The present invention employs signals provided by reference detector elements 25 and 27, which generate signals representative of the x-ray flux that does not pass through the patient 18. As shown in FIG. 2, the x-rays projected from the x-ray tube 16 impinge directly on the reference detector elements 25 and 27. It has been determined that the outputs of the reference detector elements 25 and 27 can be utilized to predict the condition of the x-ray tube 16 of the CT system. The manner in which this is accomplished will now be discussed with reference to FIGS. 2–5. By way of example, and not limitation, the following discussion refers to reference detector elements located on each end of detector 15, as shown in FIG. 2; alternatively, the output values of a reference detector element disposed at any appropriate place (e.g., to receive x-rays directly from x-ray source 16) in the CT system can similarly be used for predicting the condition of the x-ray tube.

Figure 3:
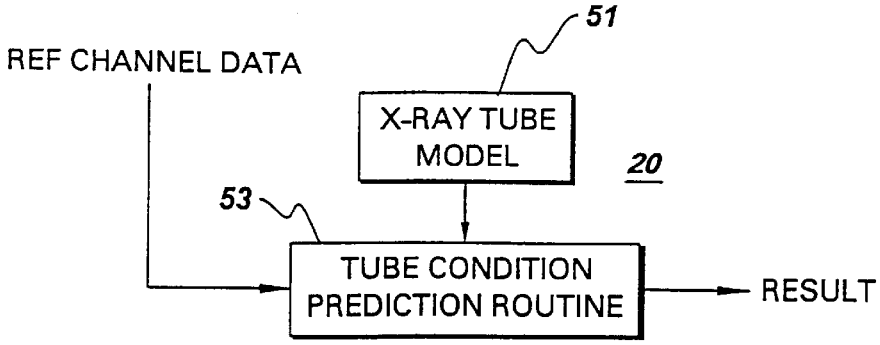
FIG. 3 is a block diagram generally illustrating the functional components of the tube condition prediction algorithm of the invention.

FIG. 3 is a block diagram generally illustrating the functional components of the tube condition prediction device 20. The tube condition prediction device 20 utilizes a model 51 of the x-ray tube 16 and a tube condition prediction routine 53 to predict the condition of x-ray tube 16. The model 51 typically is generated by using historical generic tube performance data that have been collected and the model further includes tube performance data that have been found to be precursors of conditions that lead to the failure of the x-ray tube 16. Alternatively, the model 51 may be generated by using engineering principles of other modeling techniques to predict conditions that lead to failure of the x-ray tube 16. Those skilled in the art will understand the manner in which any of these techniques may be utilized to generate the model 51 to be used by the tube condition prediction device 20 of the invention.

In the embodiment to which data model 51 is generated using historical data, the data typically are collected during various stages of the lives of many CT system x-ray tubes. When the model is generated in this manner, the accuracy of the model is generally enhanced as a greater number of data sets are utilized to generate the model. Therefore, typically the data set collected for the model 51 relates to many CT system x-ray tubes and various conditions throughout the lives of the x-ray tubes.

The tube condition prediction routine 53 of the tube condition prediction device 20 is adapted to use the model 51 to predict the operational condition of the x-ray tube 16. As used herein, "adapted to," "configured to," and the like is used generally to refer to devices being coupled to receive and process data in accordance with a program or algorithm to provide a desired output. A variety of prediction algorithms exist that are suitable for use as the tube condition prediction routine, such as neural networks or Generalized Likelihood Ratios (GLR algorithm) System identification based methods.

One prediction algorithm that is suitable for this purpose is a Kalman filter, such as a steady state Kalman filter (desirable due to its computational efficiency), and prediction Kalman filter, and an extended Kalman filter. Typically, the tube condition prediction routine 53 utilizes a Kalman filter that has been designed to utilize the model 51 to analyze data from one or both of the reference detector elements 25 and 27. By way of example and not limitation, the present invention is described below with respect to an embodiment comprising a Kalman filter, as a variety of prediction algorithms are suitable for use in the present invention. The present invention is not limited with respect to the particular prediction algorithm utilized. Prediction algorithms such as Kalman filters are generally well known in the art, a detailed discussion of the manner in which the tube condition prediction routine 53 is designed and implemented will not be provided herein in the interest of brevity.

The computer 10 that comprises the tube collection prediction device 20 typically provides a notification of tube condition predictions to a user. The notification commonly is displayed on the display monitor 11 or alternatively is displayed on a separate display monitor (not shown) connected to the computer 10. Further notification options can alternatively be used, such as printed format by printing the notification on a printer (not shown) connected to the computer 10, or electronic signal to a diagnostic monitoring device.

Figure 4:
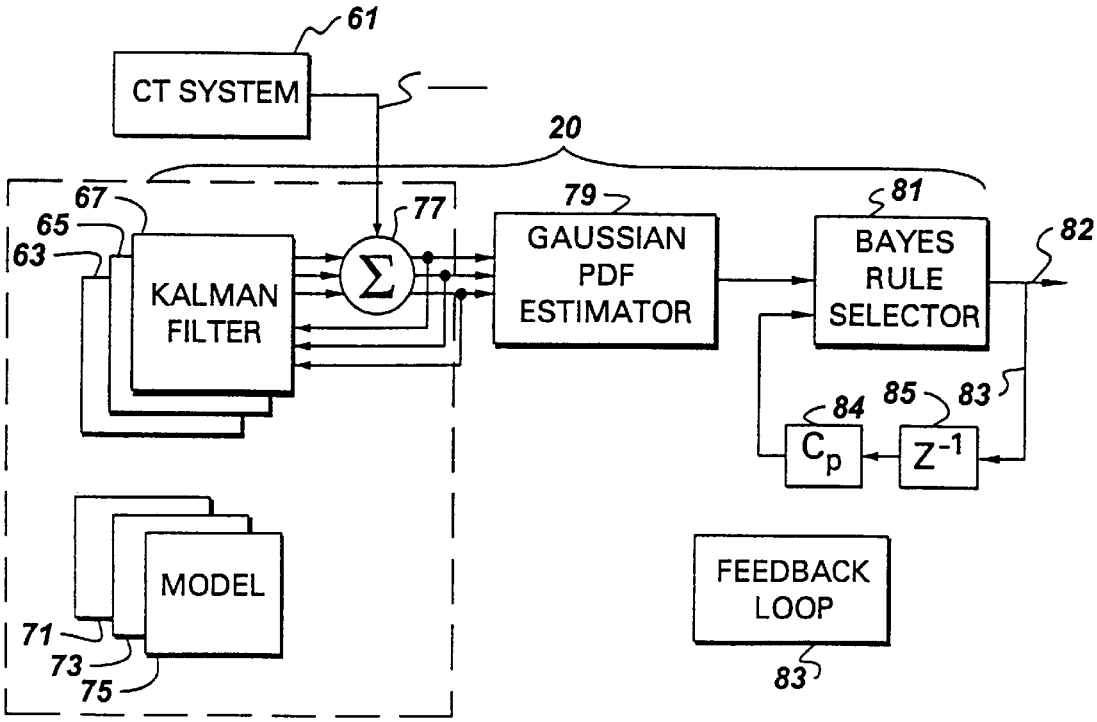
FIG. 4 is a block diagram illustrating the functional components of the tube condition prediction algorithm of the invention in accordance with the one embodiment.

FIG. 4 is a block diagram representing the functional components of the tube condition prediction device 20 in accordance with one embodiment of the invention. In accordance with this embodiment, the tube condition prediction device 20 comprises a plurality of tube condition prediction routines, each of which typically comprises a Kalman filter (63, 65 and 67 in FIG. 4) and a respective process model (71, 73 and 75 in FIG. 4). Each of the models 71, 73 and 75 is associated (that is, coupled or programmed to interface) with a respective one of the Kalman filters 63, 65 and 67.

In accordance with this embodiment, three models and three associated Kalman filters are employed in the tube condition prediction device 20. However, the invention is not limited with respect to the number of models and prediction routines that can be incorporated into tube condition prediction device 20. By way of example and not limitation, in one embodiment model 71 corresponds to (that is, represents measured performance characteristics that correlate to) an x-ray tube that is operating properly, i.e., a fault-free x-ray tube; model 73 corresponds to an x-ray tube that has begun to fail, but which still has some operational capacity (e.g., weeks or months before anticipated failure); and model 75 corresponds to an x-ray tube that is about to fail, i.e., an x-ray tube that could fail at any moment.

In an alternative embodiment, a single model and respective prediction routine algorithm can be utilized to predict failures in an x-ray tube of a CT system. For example, a single model that corresponds to characteristics of an x-ray tube having a predetermined amount of time (e.g., weeks or days of normal usage operational life) remaining before failure can be used to provide early warning of an impending failure.

In operation, signals from the reference detectors are processed by tube condition prediction device 20 to provide an output that corresponding to predicted tube condition. For example, in an embodiment in which device 20 comprises three respective Kalman filters 63, 65 and 67, respective outputs are provided by each of the Kalman filters. The Kalman filter associated with the process model that most closely corresponds with the signals being received from the reference detectors (hence representing the current condition of the x-ray tube 16) will generate an innovations process output which is close to white noise, while the others will generate innovations process outputs with significant time correlation. "Innovations process output" as used herein refers to the difference between the predicted signal generated by the model for particular operating parameters and the corresponding measured values of such operating parameters. Therefore, the model associated with the Kalman filter that generates an innovations process output that most closely resembles white noise will be selected as the model that corresponds to the condition of the x-ray tube.

In tube condition prediction device 20 depicted in FIG. 4, Kalman filters 63, 65 and 67 utilize respective process models 71, 73 and 75 and a set of process measurements (from CT system 61) obtained from the outputs of the reference detector elements 25 and 27 to obtain an estimate of the condition of the x-ray tube. The Kalman filters 63, 65 and 67 are respectively coupled to summing junction 77, which in urn is coupled to the CT system 61 (e.g., receiving process measurements from reference channels 25, 27). Summing junction 77 is further coupled to gaussian PDF estimator 79.

The Kalman filters 63, 65 and 67 utilize the models 71, 73 and 75, respectively, to estimate the performance of the CT system 61. The outputs from the Kalman filters are then subtracted from the reference channel data at the summing junction 77. The outputs from the summing junction 77 are time series calculations of the differences between the process parameters output (reference channel data) from the CT system and the process parameters estimated by the Kalman filters 63, 65 and 67, which is called "innovations process output." Each time series corresponds to an innovations process output, which is associated with a particular filter.

The innovations process outputs are fed back to the Kalman filters to be used by the Kalman filters to correct the state estimate in accordance with typical operation of Kalman filters. The innovations process outputs are also input into gaussian probability distribution function (PDF) estimator 79. The gaussian PDF estimator 79 estimates the probability distribution function for each of the innovations process outputs.

Gaussian PDF estimator 79 is coupled to a Bayes Rule selector 81 so as to provide the estimates of the probability distribution functions output from the gaussian PDF estimator 79 to selector 81. The Bayes Rule selector 81 processes the estimates output from the gaussian PDF estimator and selects the estimate that has the highest probability of corresponding to white noise. The Bayes Rule selector 81 then outputs a result 82 that indicates which of the probability distribution functions most likely corresponds to white noise. The feedback loop 83 comprising components 84 and 85 provides exponential weighting of previous data. The weighting function provides a selection (typically in the design process) between a desired response time and a desired sensitivity to noise.

The gaussian PDF estimator 79 and the Bayes Rule selector 81 and the manner in which they are designed and implemented are well known. Therefore, a discussion of the manner in which these components are designed and implemented to process the outputs of the Kalman filters 63, 65 and 67 will not be provided herein in the interest of brevity.

Figure 5:
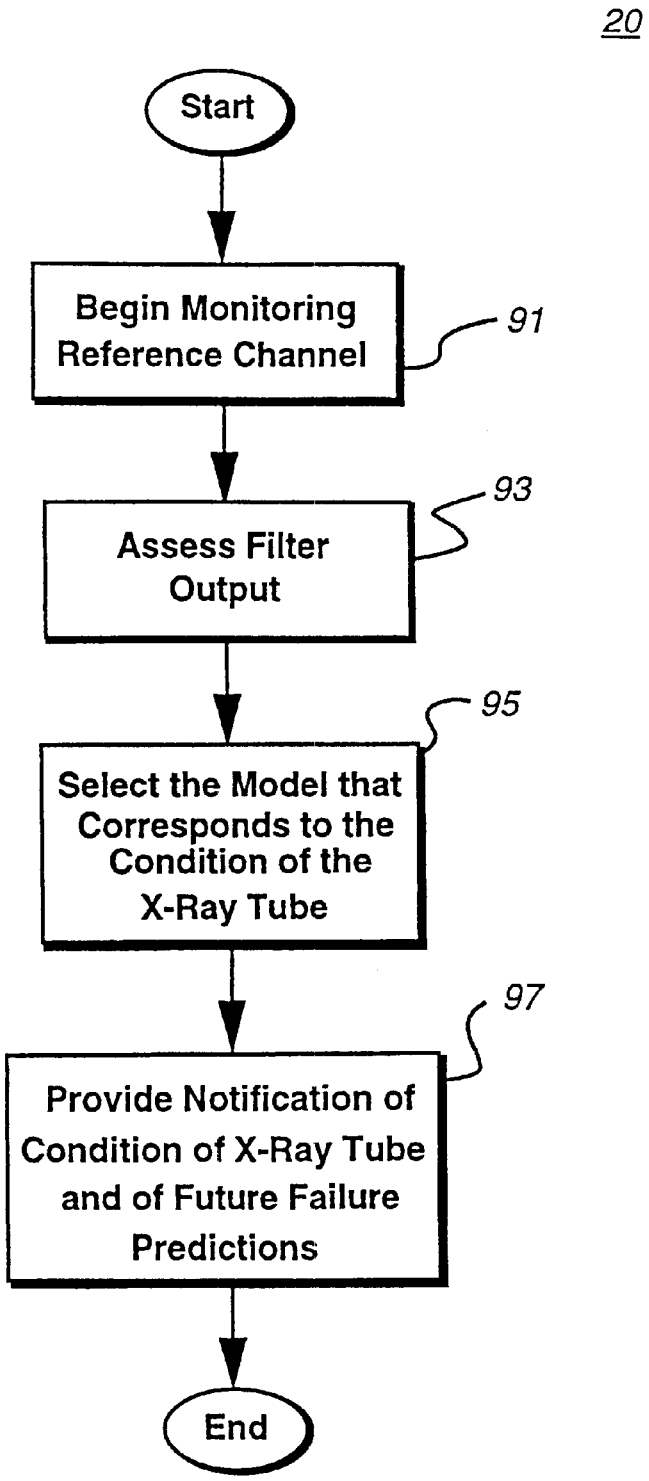
FIG. 5 is a flow chart generally illustrating the algorithm of the invention for predicting failures in a CT system x-ray tube.

FIG. 5 is a flow chart illustrating the functions performed by the tube condition prediction device 20 represented by the block diagram of FIG. 4. When the computer 10 is executing the tube condition prediction algorithm, the computer 10 monitors the output values from the reference detector elements 25 and 27, as indicated by block 91. The computer 10 assesses which of the Kalman filters is generating an innovations process output that most closely resembles white nose, as indicated by block 93.

The computer 10 then identifies, based upon filter output, the process model that most closely corresponds to the reference channel data being processed, as indicated by block 95. The computer 10 then provides a notification to the user of the predicted condition of x-ray tube 16 and of future failure predictions, as indicated by block 97. The notification routine can be part of the tube condition prediction algorithm or it can be a separate routine performed by the computer 10.

Typically, the computer 10 executes a separate notification routine that processes the results output from the tube condition prediction device 20 to produce a notification that is provided to the user. However, those skilled in the art will understand that the notification routine may be comprised as part of the tube condition prediction device 20 if so desired.

It should be noted that the invention has been described with reference to particular embodiments, but that the invention is not limited to these embodiments. Those skilled in the art will understand that other modifications may be made to the embodiments discussed herein that are within the scope of the invention.

What is claimed is:

1. An apparatus for predicting the condition of an x-ray tube of a computed tomography (CT) system, the CT system comprising a detector having a plurality of detector elements, the detector elements comprising at least one reference detector element, the apparatus comprising:

a computer comprising a tube condition prediction device, the computer being coupled to the detector to receive electrical signals from the detector, the tube condition prediction device being programmed to run a tube condition algorithm that is responsive to signals received from the at least one reference detector and to generate an indication of x-ray tube condition.

2. The apparatus of claim 1 further comprising a second reference detector element, each of said reference detector elements being disposed to receive x-rays projected from the x-ray tube without passing through the object being imaged by the CT system.

3. The apparatus of claim 1, wherein the tube condition prediction device comprises at least a first model and at least a respective first tube condition prediction routine, the first model representing an x-ray tube having a first selected operational condition, the first tube condition prediction routine being adapted to use the model to process signals from the at least one reference detector element so as to generate a respective first prediction routine output, the prediction routine output being assessed by the computer to provide the indication of x-ray tube condition.

4. The apparatus of claim 3, wherein the tube condition prediction device utilizes at least a second model and a respective second tube condition prediction routine, the second model corresponding to a second selected x-ray tube operational condition, the second tube condition prediction routine being adapted to use the model to process signals from the at least one reference detector elements so as to generate a respective second prediction routine output, the prediction routine output being assessed by the computer to provide the indication of x-ray tube condition.

5. The apparatus of claim 4, wherein the tube condition prediction device utilizes at least a third model and a respective third tube condition prediction routine, the third model corresponding to a third selected x-ray tube operational condition, the third tube condition prediction routine being adapted to use the model to process signals from the at least one reference detector elements so as to generate a respective third prediction routine output, the prediction routine output being assessed by the computer to provide the indication of x-ray tube condition.

6. The apparatus of claim 5 wherein the computer is adapted to assess the respective first, second and third prediction outputs to determine the respective prediction routine output indicative of the current operational status of the x-ray tube.

7. The apparatus of claim 1 wherein the tube condition prediction device is adapted to operate respective tube condition prediction routines coupled with respective tube performance models, at least one of said routines comprising a Kalman filter.

8. The apparatus of claim 7, wherein the tube condition prediction comprises hardware configured to perform the functions associated with the models and the Kalman filters, and further comprises a gaussian probability distribution function estimator and a Bayes Rule selector.

9. A method for predicting the operational condition of an x-ray of a computed tomography (CT) system, the CT system comprising a detector, the detector comprising at least one reference detector element, the method comprising the steps of:

receiving electrical signals from the at least one reference detector element; and analyzing the received electrical signals to predict the operational condition of the x-ray tube.

10. The method of claim 9, wherein the detector comprises a second reference detector element, and the step of receiving electrical signals comprises the steps of receiving electrical signals from the first and second reference detector elements.

11. The method of claim 9, wherein the analyzing step comprises applying at least a first tube model and at least a first tube condition prediction routine, the first tube model representing an x-ray tube having a respective operational condition, the first tube condition prediction routine processing signals from the at least one reference detector element to provide a respective prediction routine output, the analyzing step further comprising assessing the prediction routine output to provide an indication of x-ray tube operational condition.

12. The method of claim 11, wherein the analyzing step comprises applying a second tube model and a second tube condition prediction routine, the second tube model representing an x-ray tube having a respective operational condition, the second tube condition prediction routine processing signals from the at least one reference detector element to provide a respective second prediction routine output, the analyzing step further comprising assessing the second prediction routine output to provide an indication of a x-ray tube operational condition.

13. The method of claim 12, wherein the analyzing step comprises applying a third tube model and a third tube condition prediction routine, the third tube model representing an x-ray tube having a respective operational condition, the third tube condition prediction routine processing signals from the at least one reference detector element to provide a respective third prediction routine output, the analyzing step further comprising assessing the third prediction routine output to provide an indication of x-ray tube operational condition.

14. The method of claim 13, wherein the analyzing step further comprises assessing the first, second and third prediction routine outputs to determine the respective prediction routine output indicative of the current operational status of the x-ray tube.

15. The method of claim 9 wherein the analyzing step further comprises applying a tube condition prediction routine, the routine comprising application of a Kalman filter.

16. The method of claim 15, wherein the tube condition prediction routine is implemented in hardware, the hardware being configured to perform the functions associated with the models and the Kalman filters, and to perform a gaussian probability distribution function estimation and a Bayes Rule selection process.

17. A computer program for predicting the operational condition of an x-ray tube in a computed tomography (CT) system, the CT system comprising a detector, the detector comprising a plurality of detector elements, the detector elements comprising at least a first reference detector element disposed adjacent a first end of the detector and a plurality of imaging detector elements, wherein x-rays projected from the x-ray tube impinge directly on the first reference detector element without passing through an object being imaged by the CT system, and wherein x-rays projected from the x-ray tube may pass through the object being imaged before impinging on the remaining imaging detector elements, the computer program being embodied on a computer-readable medium, the computer program comprising:

a first code segment, the first code segment receiving electrical signals from the detector, the electrical signals corresponding to x-rays impinging on the first reference detector element; and a second code segment, the second code segment analyzing the received electrical signals to predict the operational condition of the x-ray tube.

18. The computer program of claim 17, wherein a second reference detector element is disposed adjacent to a second end of the detector, the imaging detector elements being disposed in between the first and second reference detector elements, x-rays projected from the x-ray tube impinging directly on the second reference detector element without passing through the object being imaged by the CT system, the first code segment receiving electrical signals from the first and second reference detector elements, the electrical signals corresponding to x-rays impinging on the first and second reference detector elements, wherein the second code segment analyzes the received electrical signals to predict a failure in the x-ray tube.

19. The computer program of claim 18, wherein the second code segment comprises code representing at least a first model and at least a first Kalman filter, the first model representing an x-ray tube having a particular fault associated therewith, the code representing the first Kalman filter utilizing the code representing the first model to process the values output from the at least one reference detector elements, the code representing the first Kalman filter generating a first innovations process output, the first innovations process output being analyzed by the second code segment to determine whether the first innovations process output resembles white noise, wherein if a determination is made by the second code segment that the first innovations process output resembles white noise, a determination is made by the second code segment that the x-ray tube has the fault associated with the first model.

20. The computer program of claim 19, wherein the second code segment comprises code representing at least a second model and at least a second Kalman filter, the second model corresponding to a fault-free x-ray tube, the code representing the second Kalman filter utilizing the code representing the second model to process the values output from the at least one reference detector elements, the code representing the second Kalman filter generating a second innovations process output, the second innovations process output being analyzed by the second code segment to determine whether the second innovations process output resembles white noise, wherein if a determination is made by the second code segment that the second innovations process output resembles white noise, then a determination is made by the second code segment that the x-ray tube is free of faults.

21. The computer program of claim 20, wherein the second code segment comprises code representing at least a third model and at least a third Kalman filter, the third model corresponding to a particular fault in the x-ray tube, the code representing the third Kalman filter utilizing the code representing the third model to process the values output from the at least one reference detector elements, the code representing the third Kalman filter generating a third innovations process output, wherein the third innovations process output is analyzed by the second code segment to determine whether the third innovations process output resembles white noise, wherein if a determination is made during the analyzing step that the third innovations process output resembles white noise, then a determination is made by the second code segment that the x-ray tube has the fault associated with the third model.

22. The computer program of claim 21, wherein the second code segment analyzes the first, second and third innovations process outputs by performing a gaussian probability distribution function estimation on each of the innovations process outputs to generate a probability distribution function estimate for each of the innovations process outputs, and by performing a Bayes Rule selection process on the estimates, wherein each estimate is associated with one of the models, and wherein the Bayes Rule selection process processes the estimates and determines which of the estimates most likely corresponds to white noise, wherein the second code segment determines that the condition of the x-ray tube corresponds to the model associated with the estimate that was determined to most likely correspond to white noise.

23. A computed tomography (CT) system adapted to predict the operational condition of an x-ray tube of the CT system, the CT system comprising:

a plurality of detector elements, the detector elements comprising at least a first reference detector element disposed adjacent to a first end of the detector and a plurality of imaging detector elements, wherein x-rays projected from the x-ray tube impinge directly on the first reference detector element without passing through an object being imaged by the CT system, and wherein x-rays projected from the x-ray tube may pass through the object being imaged before impinging on the remaining imaging detector elements, the detector elements generating electrical signals in response to x-rays impinging thereon;

read-out electronics coupled to the detector elements, the read-out electronics reading out the electrical signals and converting the electrical signals into digital signals; and a computer programmed to execute a tube condition prediction algorithm, the computer being in communication with the read-out electronics, the computer receiving digital signals from the read-out electronics, the digital signals received by the computer corresponding to x-rays impinging on the first reference detector element, wherein when the tube condition prediction algorithm is executed by the computer, the computer analyzes the digital signals received thereby to predict a failure in the x-ray tube.

24. The CT system of claim 23, wherein a second reference detector element is disposed adjacent to a second end of the detector, the imaging detector elements being disposed in between the first and second reference detector elements, x-rays projected from the x-ray tube impinging directly on the second reference detector element without passing through the object being imaged by the CT system, the digital signals received by the computer corresponding to x-rays impinging on the first and second reference detector elements, wherein when the tube condition prediction algorithm is executed by the computer, the computer analyzes the electrical signals received thereby to predict a failure in the x-ray tube.

25. The CT system of claim 23, wherein the tube condition prediction algorithm utilizes at least a first model and at least a first Kalman filter, the first model representing an x-ray tube having a particular fault associated therewith, the first Kalman filter utilizing the model to process the values output from the at least one reference detector element, the first Kalman filter generating a first innovations process output, the computer analyzing the first innovations process output to determine whether the first innovations process output resembles white noise, wherein when a determination is made by the computer that the first innovations process output resembles white noise, the computer determines that the x-ray tube has the fault associated with the first model.

26. The CT system of claim 25, wherein the tube condition prediction algorithm utilizes at least a second model and at least a second Kalman filter, the second model corresponding to a fault-free x-ray tube, the second Kalman filter utilizing the model to process the values output from the at least one reference detector element, the second Kalman filter generating a second innovations process output, the computer analyzing the second innovations process output to determine whether the second innovations process output resembles white noise, wherein when a determination is made by the computer that the second innovations process output resembles white noise, the computer determines that the x-ray tube is free of faults.

27. The CT system of claim 26, wherein the tube condition prediction algorithm utilizes at least a third model and at least a third Kalman filter, the third model corresponding to a particular fault in the x-ray tube, the third Kalman filter utilizing the third model to process the values output from the at least one reference detector element, the third Kalman filter generating a third innovations process output, the computer analyzing the third innovations process output to determine whether the third innovations process output resembles white noise, wherein when a determination is made by the computer that the third innovations process resembles white noise, the computer determines that the x-ray tube has the fault associated with the third model.

28. The CT system of claim 27, wherein when the computer analyzes the first, second and third innovations process outputs, the tube condition prediction algorithm performs a gaussian probability distribution function estimation on each of the innovations process outputs to generate a probability distribution function estimate for each of the innovations process outputs, each estimate being associated with one of the models, and wherein the tube condition prediction algorithm performs a Bayes Rule selection process on the estimates, the Bayes Rule selection process processing the estimates and determining which of the estimates most likely corresponds to white noise, the tube condition prediction algorithm determining that the condition of the x-ray tube corresponds to the model associated with the estimate determined to most likely correspond to white noise.

29. The CT system of claim 23, wherein the tube condition prediction algorithm is implemented in software, and wherein the tube condition prediction algorithm is executed when the software is executed on the computer.

30. The CT system of claim 28, wherein the tube condition prediction algorithm is implemented in hardware, the computer being comprised of the hardware, the hardware being configured to perform the functions associated with the models and the Kalman filters, and to perform the gaussian probability distribution function estimations and the Bayes Rule selection process.

* * * * *